US005135250A

United States Patent [19]

Abondance et al.

[11] Patent Number: 5,135,250

[45] Date of Patent: Aug. 4, 1992

[54] ACCESSORY DEVICE FOR SKIS, PERMITTING INSTALLATION OF A SET OF BOOT BINDINGS ON A SKI

[75] Inventors: Roger Abondance, Rives sur Fure; Adrien Duvillard, Megeve, both of France

[73] Assignee: Skis Rossignol S.A., Voiron, France

[21] Appl. No.: 552,453

[22] Filed: Jul. 16, 1990

[30] Foreign Application Priority Data

Jul. 18, 1989 [FR] France ..... 8910378

[51] Int. Cl.[5] ..... A63C 9/08

[52] U.S. Cl. ..... 280/617; 280/618; 280/633

[58] Field of Search ..... 280/617, 618, 611, 607, 280/633, 616, 636, 601

[56] References Cited

U.S. PATENT DOCUMENTS

| | | | |
|---|---|---|---|
| 3,260,532 | 7/1966 | Heuvel | 280/602 |
| 3,326,564 | 10/1964 | Heuvel | 280/602 |
| 3,797,844 | 3/1974 | Smolka et al. | 280/617 |

FOREIGN PATENT DOCUMENTS

| | | |
|---|---|---|
| 1215403 | 12/1986 | Canada . |
| 2259375 | 6/1974 | Fed. Rep. of Germany . |
| 3710092 | 10/1988 | Fed. Rep. of Germany . |
| 810762 | 3/1937 | France . |
| 2575393 | 6/1966 | France . |
| 2338720 | 8/1977 | France . |
| 2347066 | 11/1977 | France . |
| 2409776 | 6/1979 | France . |
| 2476495 | 4/1983 | France . |
| WO8303360 | 10/1983 | PCT Int'l Appl. . |
| WO8604824 | 8/1986 | PCT Int'l Appl. . |

*Primary Examiner*—Andres Kashnikow
*Assistant Examiner*—Richard M. Camby
*Attorney, Agent, or Firm*—Oliff & Berridge

[57] ABSTRACT

Downhill skis include a plate, positioned at a distance from the top surface of each ski, for holding the bindings. The plate is immovable in lateral directions of the ski. The plate is permitted to be displaced longitudinally with respect to the ski against the action of at least one elastic support at an end of the plate. The elastic support can include a visco-elastic material.

32 Claims, 4 Drawing Sheets

ACCESSORY DEVICE FOR SKIS, PERMITTING INSTALLATION OF A SET OF BOOT BINDINGS ON A SKI

BACKGROUND OF THE INVENTION

The object of the present invention is an accessory device for skis, permitting a set of boot bindings to be mounted on a ski.

Traditionally, a boot is attached to a downhill ski by a set of safety bindings comprising a toe binding located at the front of the boot and a heel binding located at the rear thereof, the sole of said boot being rigid and pinched elastically between the toe and heel bindings.

The first point to be noted is that the area of the ski between the toe binding and the heel binding for holding the boot is made rigid by the boot when in use. In addition, the longitudinal force exerted by the heel binding on the boot tends to increase the camber of the ski.

It is therefore regrettable for ski manufacturers, who conduct highly exhaustive tests of the behavior of skis in the design phase, to see this behavior modified by attaching the boot to the ski in different ways.

Moreover, it has been suggested that cornering accuracy can be improved by reducing the width of the skis, especially in the bottom area. As a result of this reduced width, a ski boot will extend beyond the ski on both sides. Consequently, when making a turn, especially on a steep slope, the maximum angle is reduced and limited by the contact between the boot and the snow. In this case, rubbing of the external lateral portion of the boot mounted on the uphill ski can occur. To overcome this defect, which may cause the skier to fall, it has been suggested that the boot be superelevated to restore the maximum cornering angle obtained with wider skis. Different means have been suggested, and include the following: a wedge at the bases of the ski bindings, or an elevation of the binding and boot produced by interposing between the boot and ski, a plate which can also serve to absorb vibrations, as described in document CA 1 215 403.

In addition, a number of solutions have been proposed relating to the structure of either the ski or the bindings, the ski boots, or the interfaces between these various elements in order to improve the handling of the ski and thus take advantage of technical developments that have been made in skis, to ensure equal performance, easier maneuverability, and less fatigue for skiers.

To obtain such results, apart from advances in structure, design, choice of materials, technical features, dimensioning, and distribution of flexibility, one important factor has been selective elimination of certain ranges of harmful vibration as described in patents FR 2,476,495 and FR 2,575,393 issued in the name of the applicant.

It has also been suggested that the plates be connected to the skis to meet other needs. For example, to improve comfort and safety by eliminating microtraumas caused by significant impacts sustained by the legs of a skier when going over a hard snow drift or bumps that are very close together and form very hard undulations, it has been suggested to insert a type of "elastic suspension" between the ski and each of the skier's feet, said suspension taking the form of an elastic plate of the leaf spring type as described in French Patents 2,347,066 and 2,338,720, or an elastic plate mounted on coil springs or elastic plugs as described in FR 2,409,776, WO 86/04824, DE 2,259,375, and CA 1,215,403.

Document WO 83/03360 in turn describes a plate bearing boot bindings whose ends are attached to the ski and delimit together with the latter, a space filled with a shock-absorbing material. Document EP 0,182,776 describes a plate in contact with the ski in two areas.

U.S. Pat. No. 3,797,844 describes a plate for mounting bindings, one end of said plate being attached to the ski and the other being free to slide relative to the ski. It has also been suggested that a plate be mounted on the ski, said plate being designed to correct morphological deformities of the skier, for example, a difference in the lengths of his/her legs, or joint problems as described in German Patent DE 3,710,092.

It has also been suggested that plates be used to reinforce a ski locally, especially in torsion as described in U.S. Pat. No. 3,326,564.

Another use of the distribution plate was suggested to correct the position where the force generated by the skier's weight is applied, said position generally being located at a point identified on the ski by the position of the middle of the boot, so that this plate, attached to the ski at the front and rear of the bottom, divides the skier's weight into two forces applied to the front and rear quarters of the ski as described in U.S. Pat. No. 3,260,532 and French Patent 810,762.

In fact, this solution, instead of improving the handling of the ski, has been found to be rather unfavorable because it reduces the efficiency with which turns are made, making cornering more difficult to start and perform because the pressure distribution peaks on the snow are poorly positioned.

SUMMARY OF THE INVENTION

The goal of the invention is to provide an accessory device for a ski, developed and adjusted to have a positive effect on the behavior of the ski on the snow by favorably modifying its rigidity in flexion and torsion.

The goal of the invention is to provide a device comprising a support plate for a set of boot bindings to permit the following:

- regular deformation of the ski over its entire length, under operating conditions, with the least constraint possible;
- elevation of the boot, possibly adjustable, to improve turning efficiency;
- adjustable longitudinal and lateral positioning of the boot bindings relative to the ski;
- interchangeable mounting of different size boots without having to use special binders of the "rental" type;
- adjustment of a ski to the morphological defects of a skier;
- improvements in the installation of bindings as well as the anchoring thereof.

To this end, the device in question, of the type comprising a plate to receive the set of bindings, positioned at a distance from the upper surface of the ski, with no provision for moving laterally on the ski, is characterized by the plate being associated with means allowing its longitudinal displacement relative to the ski, against the action of at least one elastic support at each of its ends.

One simple embodiment of this device comprises at least one slide which, attached to the ski and oriented longitudinally with respect thereto, permits a plate to be mounted so that it can slide at a distance above the upper surface of the ski, said plate being equipped with a set of bindings and two stops which, attached to the ski, are both designed to provide elastic support at the front and rear of the plate.

The plate is mounted above the upper surface of the ski and raises the boot above the position in which it rests directly on the ski.

In addition, this plate, being displaceable lengthwise against the elastic means, allows free deformation of the ski in use.

Finally, this plate is mounted removably and interchangeably so that it can be replaced virtually instantaneously by another plate with different characteristics or fitted with bindings designed for another size ski.

The elastic supports can be made of a viscoelastic material associated with stops against which the plate rests or with other elastic supports such as coil or leaf springs.

According to the embodiments, the elastic supports can be prestressed in a definitive fashion or provided with means for adjusting prestressing by modifying the axial position of the stops or by displacement of a supporting element on the plate or on an elastic element associated with one of the stops.

The slides supporting the plate can be mounted to be adjustable longitudinally or laterally, or can even be equipped with wedges to adjust their height.

A plug made of viscoelastic material inserted locally between the plate and ski serves to damp parasitic vibrations. Finally, since the locations for mounting the slides and/or stops of the plate on the ski are predetermined, it is possible to predrill at the factory the holes intended for attaching these elements by screwing.

According to other characteristics of the invention, the plate, which is an accessory for the ski, can be made of an aluminum alloy or a laminate composed of glass fiber, carbon fiber, aramid (KEVLAR) or mixtures thereof, with an epoxy matrix, or can be made of an aluminum alloy laminate, in a thin sandwich comprising a viscoelastic material: zicral-viscoelastic, laminate-viscoelastic, zicral-viscoelastic- laminate. This plate can also be ribbed. Finally, the stops on the plate can be part of the structure of the ski.

According to another embodiment of this device, the height of the guide zones for each slide is greater than the thickness of the parts of the plate guided in these zones, and at least one element made of a viscoelastic material is in contact both with the lower face of the plate and with each slide.

The viscoelastic material therefore forms one of the contact surfaces of the plate during its longitudinal sliding movement. It ensures that the plate will slide even if it has a slope relative to the slides. The compressibility of the viscoelastic material limits the risk of jamming.

The viscoelastic material can be interposed between each slide and the plate in the guide zones for each slide which guide the plate, or can be inserted between each slide and the plate, between the base of the slide attached to the ski and the lower face of the plate, or in both these ways. In the latter arrangement, the viscoelastic material on the guide zone for each slide is harder than the viscoelastic material between the plate and the base of the slide.

The layer of viscoelastic material covering each guide zone for the slides forms a damped end-of-travel stop.

The viscoelastic material interposed between the plate and base of each slide can be in the form of strips, studs, or balls in a cage.

It is advantageous to adapt the characteristics of the visco-elastic material to the weight of the skier, as well as the skier's technique. This adaptation can be made by varying the hardness of the material, the shape of the viscoelastic elements, or the contact surface between the latter and the support plate for the bindings.

The number of elements can be adapted to the characteristics of the skier and the degree of absorption can be changed, for example by providing strips of precut viscoelastic material marked with references indicating the length of the strip to be used in a given case. When studs are used, the number of studs between each slide and the binding support plate can be varied.

According to another characteristic of the invention, the surface of each viscoelastic element, when viewed parallel to the plate, increases from the top of this element toward the bottom. It is therefore possible to achieve a progressive reaction in each viscoelastic element as a function of the force resisting compression.

Advantageously, each viscoelastic element has a trapezoidal section for this purpose.

According to another embodiment, each viscoelastic element has several zones displaced vertically relative to one other, like steps.

In the latter case, the greater the compressive force on the viscoelastic material, the larger the active surface of the element.

To promote the sliding ability of the binding support plate relative to the viscoelastic elements, each of the latter consists of a composite part comprising a flexible part beside the bottom of the slide and a part with a sliding surface beside the plate.

To perform its appointed function, the viscoelastic material has a hardness between 40 and 80 Shore A.

According to another characteristic of the invention, the degree of overhang of the plate relative to the upper surface of each slide is greater than the vertical play of the plate in the slides. During compression of the viscoelastic elements, this keeps the bottom of the ski boot from coming in contact with the upper wings of the slides and interfering with correct operation of the device.

BRIEF DESCRIPTION OF THE DRAWINGS

In any event, the invention will be clearly understood from the following description with reference to the attached schematic diagram, showing several embodiments of this device as nonlimiting examples.

DESCRIPTION OF PREFERRED EMBODIMENTS

Figure 1:
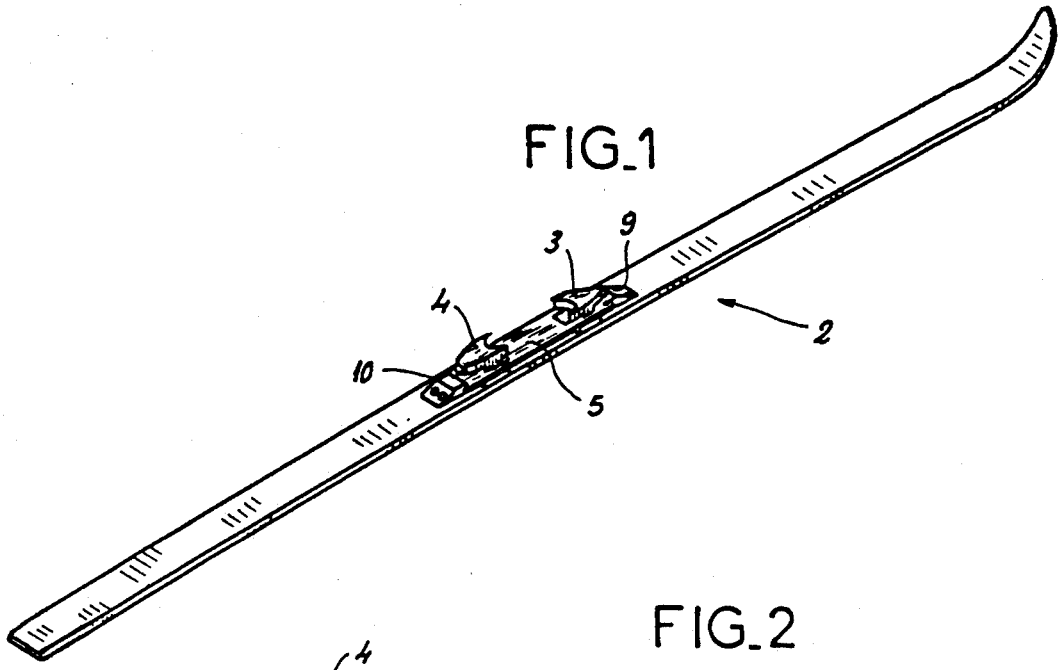
FIG. 1 is a perspective view of a downhill ski equipped with this device.

FIG. 1 shows a downhill ski 2 on which a ski boot is mounted by a binding system comprising, in a manner known of itself, a toe binding 3 and a heel binding 4. Binding system 3, 4 is not mounted directly on the ski in the usual fashion but on a rectangular plate 5 slightly longer than the total length of the boot plus toe binding 3 to heel binding 4. Plate 5, made of a material with good mechanical strength, a light alloy for example, is mounted on ski 2 by two slides 6 in the embodiment shown in the drawing. The two slides 6 are rigidly mounted on the ski, oriented longitudinally with respect to the latter, and permit engagement of plate 5 by sliding it lengthwise. The two slides 6, with a length variable between 2 and 15 cm, are disposed essentially at the locations of toe binding 3 and heel binding 4.

Consequently, plate 5 equipped with the binding system is superelevated relative to the plane of the top surface of the ski. As shown more particularly in FIG. 4, each slide 6 is attached to the ski by means of screws 7 passed through elongated holes running transversely across the ski. This permits the position of each slide to be adjusted laterally to shift plate 5 more or less sideways, thus causing the longitudinal axis of the plate to form an angle with the longitudinal axis of the ski, depending on the type of performance desired by the skier.

Figure 4:
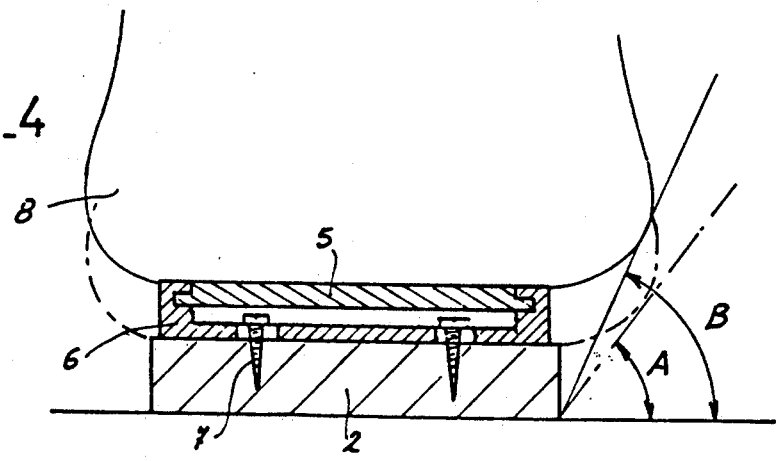
FIG. 4 is an enlarged cross section, along line IV—IV in FIG. 2, with the traditional position of a boot being represented by dot-dashed lines.

It is also evident from FIG. 4 that superelevating the binding system makes it possible to increase the turning angle relative to that obtainable with a traditional mount. While in a traditional mount where the binding system is attached directly to the ski, the turning angle which can be reached before boot 8 comes in contact with the snow, is assigned a value A as a result of the elevation produced by the slides on plate 5, this angle is greater than A in the device according to the invention and is designated B in FIG. 4.

It is also possible, in a manner not shown in the drawing, to provide slides of different thicknesses or to associate wedges of different heights with slide 6 to adjust the ski to the operating conditions desired by the skier or to take his or her morphology into account, such as malformations or differences in the lengths of the legs.

Figure 2:
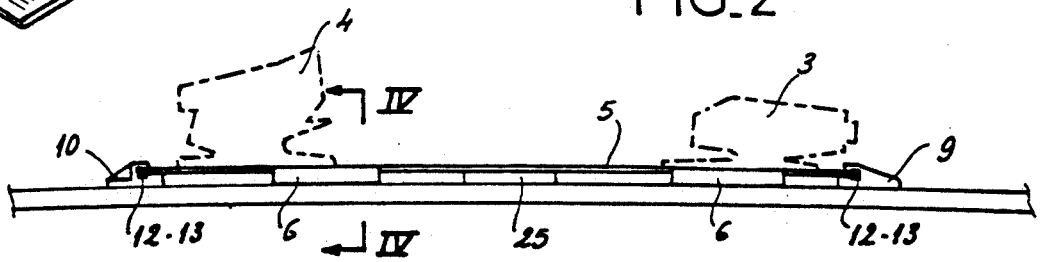
FIG. 2 is an enlarged side view of the central part of the ski in FIG. 1.
Figure 3:
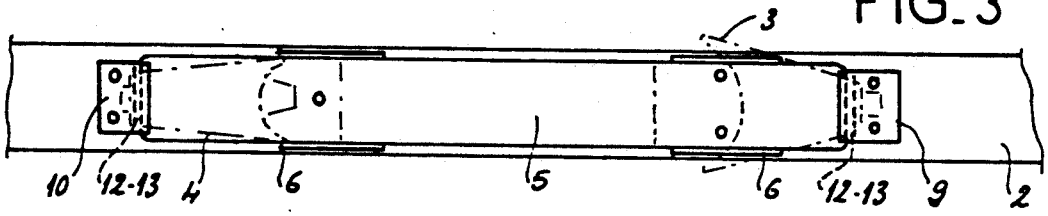
FIG. 3 is a top view showing the boot binding system, indicated by dot-dashed lines.

In the embodiment shown in FIGS. 2 and 3, the device according to the invention comprises two stops 9 and 10 which are part of the ski or are attached thereto by screwing, stop 9 being located at the front of plate 5 and stop 10 at the rear of plate 5. Each of these two stops 9 and 10 comprises a slot 12 parallel to the top of the ski, opening toward the rear in the case of stop 9 and toward the front in the case of stop 10. Each of these slots 12 is filled for part of its depth with a viscoelastic material 13. The front and rear edges of plate 5 abut the interiors of slots 12 in contact with the viscoelastic material.

This provides a plate mount that ensures immobilization both transversely and vertically relative to the ski, but makes provision for longitudinal movement against the action of elastic means constituted by viscoelastic material 13.

It should be pointed out that the ski design takes advantage of the mechanical characteristics of plate 5. Moreover, since it is mounted to float longitudinally on the ski, plate 5 scarcely interferes with deformation of the ski, with all of the parts of the ski being involved in deformation in the same way, in contrast to traditional skis in which the part at the level of the ski boot is blocked by the latter. It is also interesting to note that it is possible to use, for the same type of ski, different types of plates with mechanical characteristics which are themselves different, with each type of plate conferring a specific behavior on a given type of ski. A skier could therefore combine with a given ski, the type of plate best suited for the ski performance which he wants to obtain.

Figure 5:
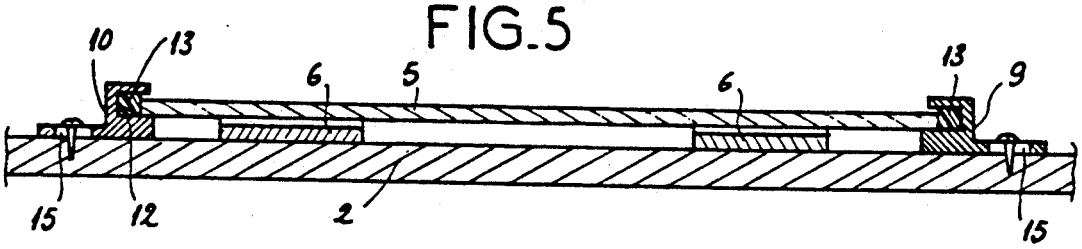
FIG. 5 is an enlarged longitudinal section of a variation on the device in FIG. 2 without the boot binding system.

The behavior of the ski can also be influenced by adjusting either the pretensioning of the elastic means constituting the plate stops or by displacing the plate lengthwise. To this end, in the embodiment shown in FIG. 5, wherein the same elements are designated by the same references as before, stops 9 and 10 are attached to the ski by screws 14 engaging elongated holes 15 oriented longitudinally with respect to the ski. This arrangement therefore allows both longitudinal adjustment of the position of a given plate and adjustment of the pretensioning of viscoelastic elements 13.

It is also possible, when the play at holes 15 for stops 9 and 10 is sufficient, to mount plates of different lengths between stops 9 and 10 to adjust the behavior of the ski to that desired by the skier.

Figure 6:
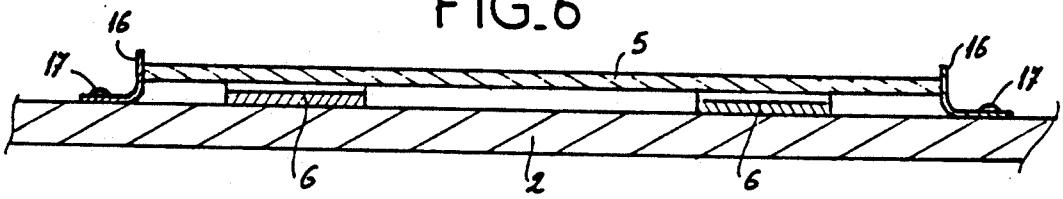
FIG. 6 is an enlarged longitudinal section of another embodiment of the device in FIG. 2.

FIG. 6 shows a variation on this device in which the two stops on plate 5 are constituted by two leaf springs 16 mounted on the ski by screws 17.

Figure 7:
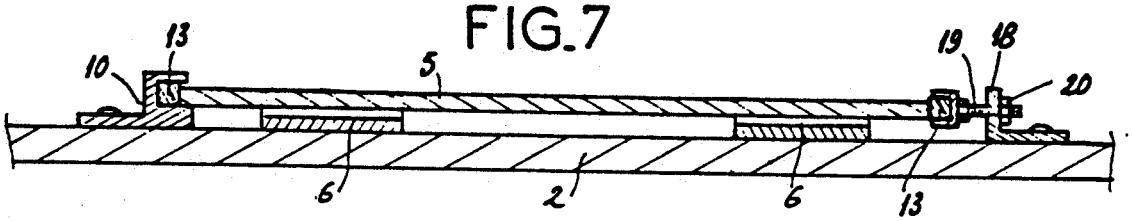
FIGS. 7 and 8 are two longitudinal sections of different embodiments of the device in FIG. 2 with adjustable elastic prestressing on the plate.

FIG. 7 shows another version of this device in which one of the stops corresponds to stop 10 in the embodiment shown in FIGS. 2 to 5, while the other stop 18 is a rigid stop comprising a finger 19 contacting one of the ends of plate 5, with the axial position of finger 19 being adjustable by a nut 20. The pressure exerted by finger 19 against one edge of the plate permits adjusting the pretensioning of viscoelastic material 13 associated with stop 10.

Figure 8:
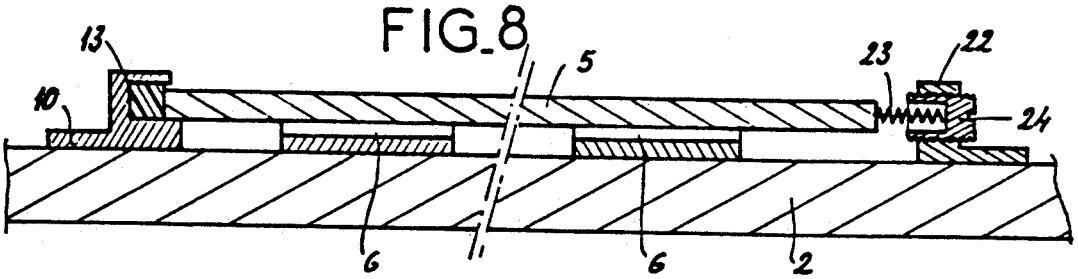

FIG. 8 shows another embodiment of the device comprising a stop 22 fitted with a coil spring 23 abutting one end edge of plate 5, with the tension of spring 23 being adjustable by a plug 24 threaded on the inside of the body of stop 22.

As shown in the drawing in FIG. 2, this device can comprise a strip 25 made of a viscoelastic material and located between plate 5 supporting the set of bindings and the top surface of the ski. This strip of viscoelastic material, without interfering with the deformation movements of the ski, absorbs the vibrations associated with the body of the ski and plate 5, thus improving the skier's comfort and the precision with which he guides the skis.

In all of the embodiments just described, slides 6 and stops 9, 10, 16, 18, and 22 are attached by screws fitted either into holes made during manufacture of the binding or into holes predrilled at the factory during manufacture of the ski, with provision for installing inserts.

The latter solution is very attractive because it reduces the amount of labor for the workers who install the bindings and ensures that the holes will be located where they will not tend to weaken the structure of the ski.

It should also be emphasized that this device is useful for renting the skis because the interchangeability of the plates allows them to be mounted on a given ski binding system that can be adapted to different size boots without having to resort to binding systems with large adjustable plates, as is usually the case.

Figure 9:
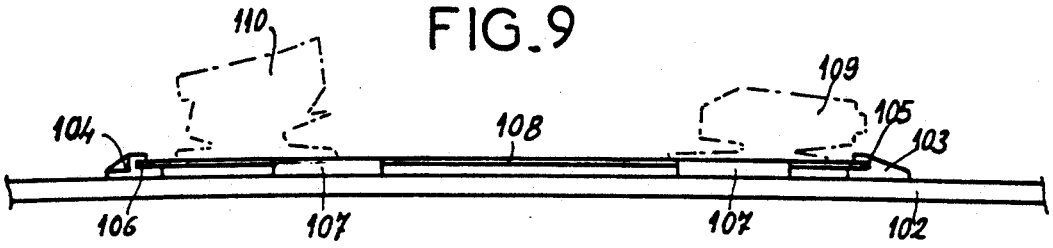
FIGS. 9 and 10 are two views showing respectively the side and top surface of a ski equipped with another device.
Figure 10:
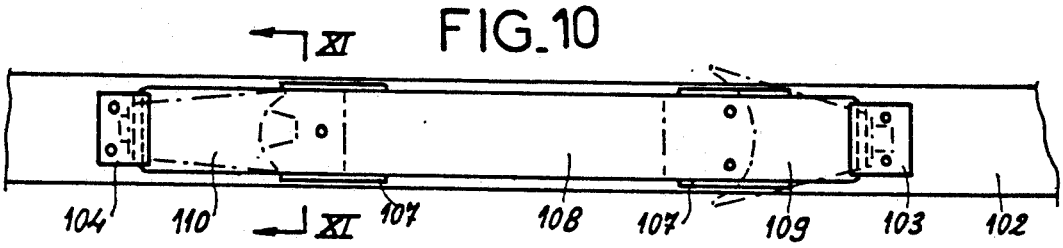

FIG. 9 shows a ski 102 fitted with two stops 103 and 104 and having slots 105 and 106 facing the rear and front respectively, the bottoms of the slots being filled with a layer of viscoelastic material.

Two double slides 107, oriented longitudinally, are mounted on the ski. A plate 108 is fitted in the slides, the ends of said plate pressing the interiors of stops 103 and 104 against the viscoelastic material in the latter.

As described above, plate 108 is fitted with a toe binding 109 and a heel binding 110, designed to grip a ski boot in an elastic fashion.

Figure 11:
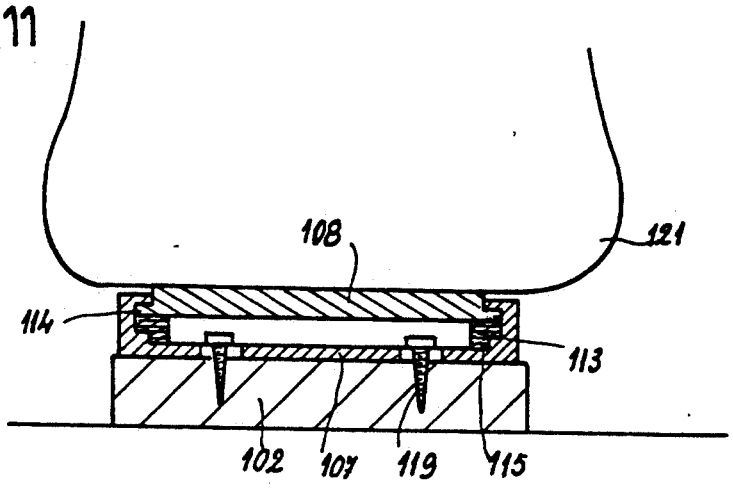
FIG. 11 is an enlarged cross section of this ski, along XI—XI in FIG. 10.

FIG. 11 shows a first embodiment of the device according to the invention. Slide 107 comprises two guide zones 113 which are longitudinal and terminate opposite one another, the height of each guide zone 113 being greater than the height of edge 114 of plate 108 designed to engage it. Each guide zone 113 has its lower part filled with a layer of viscoelastic material with a hardness between 40 and 80 Shore, abutting guided parts 114 of the plate.

Figure 12:
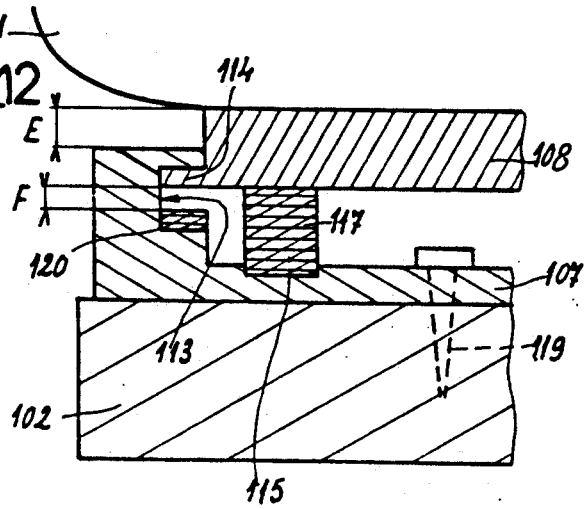
FIGS. 12 and 13 are two similar half cross sections similar to FIG. 3 and corresponding to two other embodiments of this device.

In the embodiment shown in FIG. 12, each slide is equipped with two strips 117 made of viscoelastic material, said strips being located longitudinally and each abutting a recess 115 provided in the bottom of the slide, i.e. the part of the latter attached to the ski by screws 119. The guide zone of each groove 113 is coated with a layer 120 of viscoelastic material harder than the material of strips 117.

As shown in the drawing, each edge 114 of plate 108 has vertical play F inside a guide zone 113, said play F being less than the value E of the overhang of the top surface of plate 108 relative to the top surface of the slide. When the viscoelastic material is totally compressed, the bottom of boot 121 is prevented from coming in contact with the top surface of the slide.

Figure 13:
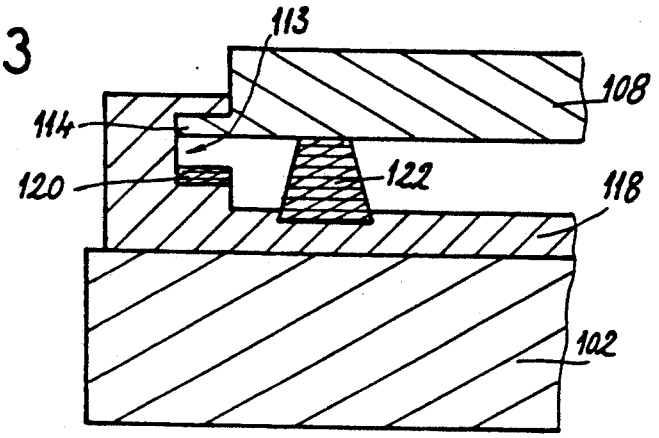

In the embodiment shown in FIG. 13, where the same elements are designated by the same reference numbers as above, the viscoelastic material between the lower face of plate 108 and the base of each slide 118 is composed of a plurality of trapezoidal studs 122, with the small surface of each stud being in contact with plate 108 while its large surface is in contact with base 118 of the slide.

Figure 14:
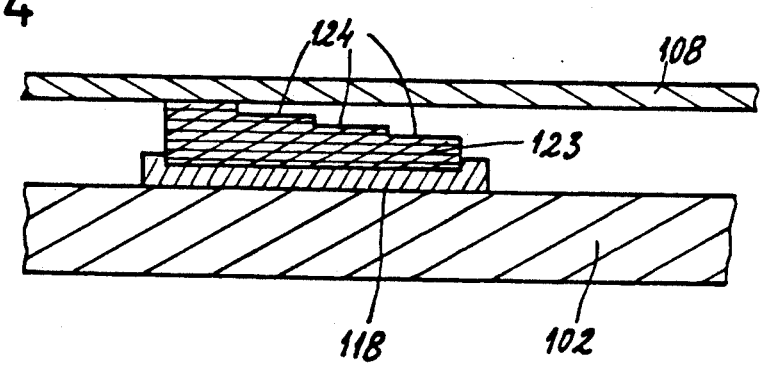
FIG. 14 is a partial longitudinal section of this device at a viscoelastic element.

FIG. 14 shows yet another embodiment in which each viscoelastic element is in the shape of a strip 123 whose top surface has successive step-shaped notches 124. In all of the embodiments shown in FIGS. 9 to 14 and just described, when the ski is deformed under normal conditions, plate 108 can slide freely without risk of jamming or interfering with its sliding within the slides, in view of the crushing abilities of the viscoelastic elements. The embodiments corresponding to FIGS. 13 and 14 allow the reaction of each viscoelastic material element as a function of the force resisting compression, to be gradual.

Of course, the invention is not limited to the embodiments of this device described above with reference to the examples; on the contrary, it includes all variations thereon. It is therefore significant that the shape of the viscoelastic elements can differ and that these elements can be provided with precut areas to permit modular assembly thereof, or that several types of elements of different shapes or types may be used to equip the same device without departing thereby from the scope of the invention.

We claim:

1. A device for mounting a set of boot bindings on a ski, comprising:

a plate for holding the set of bindings;

means for mounting the plate on the ski with the plate being positioned at a distance from the top surface of the ski;

said mounting means including means for preventing movement of the plate in the lateral direction of the ski, and said mounting means including two opposed stops, a first one of the stops being positioned at a first end of the plate and a second one of the stops being positioned at a second end of the plate opposed to the first end, each of said stops including an elastic portion coactive with the plate for permitting longitudinal displacement of the plate on the ski;

wherein each stop comprises a slot parallel to the top surface of the ski, for engaging one end of the plate, and viscoelastic material disposed in the slot in a position for engagement by the plate.

2. A device according to claim 1, wherein the mounting means comprise at least one slide attached to the ski and oriented longitudinally with respect thereto, to permit sliding of the plate at a distance from the top of the ski.

3. A device according to claim 1, wherein the mounting means includes means for adjustably pretensioning said viscoelastic material.

4. A device according to claim 1, wherein the elastic support means is prestressed in a nonadjustable manner.

5. A device according to claim 1, wherein at least one of the stops includes means for longitudinally adjusting the position of the plate.

6. A device according to claim 1, further comprising a body of viscoelastic material for interposition between the plate and a top surface of the ski.

7. A device according to claim 1, wherein the plate is of an aluminum alloy.

8. A device according to claim 1, wherein the plate comprises a laminate of glass fibers, carbon fibers, aramid fibers, or mixtures thereof, with an epoxy matrix.

9. A device according to claim 1, wherein the plate is a laminate of an alloy of aluminum and viscoelastic material.

10. A device according to claim 1, wherein the plate is of a sandwich construction including a layer of a viscoelastic material.

11. A device according to claim 1, wherein the plate is ribbed.

12. A device according to claim 1, wherein the stops are integral with the structure of the ski.

13. A device according to claim 2, wherein the slide includes guideways for receiving slide portions of the plate, a height of the guideways being greater than a height of the slide portions, and the slide includes at least one viscoelastic element in contact with both a surface of the plate and the slide.

14. A device according to claim 2, wherein said slide includes means for adjusting the height of the slide relative to the ski.

15. A device according to claim 2, wherein said slide includes means for adjusting the tilt of the slide with respect to the ski.

16. A device according to claim 2, wherein the slide includes means for providing lateral adjustment of the position of the slide with respect to the ski.

17. A device according to claim 2, further comprising a ski, said ski including mounting holes predrilled during manufacture of the ski for mounting the slide and stops.

18. A device according to claim 3, wherein the longitudinal adjusting means includes means in contact with the plate and being integral with one of the stops.

19. A device according to claim 5, wherein at least one of the stops is attached to the ski by fastener means extending through elongated holes oriented lengthwise with respect to the ski.

20. A device as in claim 11, further comprising the fastener inserts received in the mounting holes.

21. A device according to claim 13, wherein the slide includes a base and an element of viscoelastic material is disposed between the base of the slide and a lower surface of the plate.

22. A device according to claim 10, wherein the viscoelastic material is selected from the group consisting of zicral-viscoelastic, laminate-viscoelastic and zicral-viscoelastic-laminate.

23. A device according to claim 13, wherein the viscoelastic material between the slide and the plate is in the form of strips on a lower surface of the guideways of the slide.

24. A device according to claim 23, wherein the slide has a base and an element of viscoelastic material is disposed between the base of the slide and a lower surface of the plate and wherein the viscoelastic material on each guideway of the slide is harder than the element of viscoelastic material between the plate and the base of the slide, and wherein play is provided at rest between the slide portions of the plate and the viscoelastic material in the guideways of the slide.

25. A device according to claim 24, wherein the viscoelastic element between the base of the slide and the bottom surface of the plate is in the form of strips of viscoelastic material.

26. A device according to claim 25, wherein the viscoelastic material disposed between the base of the slide and the bottom surface of the slide is in the form of studs.

27. A device according to claim 21, wherein the surface of the viscoelastic element, when viewed parallel to the plate, increases from the top of the element to the bottom of the element.

28. A device according to claim 27, wherein the viscoelastic element has a trapezoidal cross section.

29. A device according to claim 27, wherein the viscoelastic element has several zones disposed vertically relative to one another stepwise.

30. A device according to claim 24, wherein the viscoelastic element comprises a flexible part near the base of the slide and a sliding surface near the plate.

31. A device according to claim 24, wherein said viscoelastic materials have hardness between 40 and 80 Shore A.

32. A device according to claim 24, wherein the top of the plate is disposed by an overhang distance from the top surface of each slide and said overhang distance is greater than the amount of play.

* * * * *